US005637036A

United States Patent [19]

Hepworth

[11] Patent Number: 5,637,036

[45] Date of Patent: Jun. 10, 1997

[54] POWER TOOL ADAPTER

[75] Inventor: Paul S. Hepworth, Guildford, United Kingdom

[73] Assignee: Turner Intellectual Property Limited, United Kingdom

[21] Appl. No.: 281,852

[22] Filed: Jul. 20, 1994

Related U.S. Application Data

[62] Division of PCT/GB93/00079, Jan. 15, 1993.

[30] Foreign Application Priority Data

Jan. 24, 1992 [GB] United Kingdom ..... 9201600

[51] Int. Cl.[6] ..... B24B 41/06

[52] U.S. Cl. ..... 451/364; 451/406; 451/367; 451/378; 451/375; 451/386

[58] Field of Search ..... 451/359, 364, 451/365, 367, 374, 375, 378, 379, 386, 406, 409, 415, 424

[56] References Cited

U.S. PATENT DOCUMENTS

| | | | |
|---|---|---|---|
| 2,754,634 | 7/1956 | French | 451/409 |
| 3,178,857 | 4/1965 | Grob et al. | 451/375 |
| 3,566,550 | 3/1971 | Piccinino | 451/364 |
| 3,698,140 | 10/1972 | Steadman | 451/375 |
| 3,849,943 | 11/1974 | Thomas et al. | 451/357 |
| 4,050,003 | 9/1977 | Owings et al. | 320/2 |
| 4,142,331 | 3/1979 | MacJannette | 451/364 |
| 4,176,499 | 12/1979 | Mazoff . | |
| 4,269,075 | 5/1981 | Crist et al. | 74/16 |
| 4,996,797 | 3/1991 | Laughton | 451/406 |

FOREIGN PATENT DOCUMENTS

| | | |
|---|---|---|
| 0381003 | 8/1990 | European Pat. Off. . |
| 2107327 | 5/1972 | France . |
| 2169457 | 9/1973 | France . |
| 2310835 | 12/1976 | France . |
| 2615774 | 12/1988 | France . |
| 3128501 | 2/1983 | Germany . |
| 0543094 | 2/1942 | United Kingdom . |
| 1233340 | 5/1971 | United Kingdom . |
| 1526169 | 9/1978 | United Kingdom . |
| 2132518 | 7/1984 | United Kingdom . |
| WO82/02507 | 8/1982 | WIPO . |

*Primary Examiner*—Timothy V. Eley
*Attorney, Agent, or Firm*—R. Gale Rhodes, Jr.

[57] ABSTRACT

An adapter (11) is of channel shape, having longitudinal projections (25) at its respective sides for engagement with undercut grooves (24) in a face of a casing of a powered grinding tool (10) with which the adapter is intended to be fitted to sharpened chisels or other planar blades, in use, by means of a grinding wheel (20) of the tool. The adapter has an angularly adjustable guide plate (63) which carrier a slidable plate (70) having magnetic means (71*a*) for holding an attracted blade of an implement to be sharpened, the angle of the guide plate (63) causing the blade to be correctly sharpened by the wheel (20), in use, as the plate (70) is reciprocated across the wheel with the blade held correctly thereon.

10 Claims, 4 Drawing Sheets

POWER TOOL ADAPTER

CROSS-REFERENCE TO RELATED APPLICATION

This application is a division of PCT GB93/00079, filed on 15 Jan. 1993, which was pending on 20 Jul. 1994.

BACKGROUND OF THE INVENTION

This invention relates to an adapter which is intended to be fitted to a powered grinding tool, the tool being primarily for use in the sharpening, smoothing, cutting, abrading, honing etc., of implements, such as drill bits, scissors, knives, chisels, planar blades and the like.

Whilst attachments for an electric drill are known which can carry out one or more of the various operations referred to above, their major disadvantage is of course that the drill cannot be used for its intended purpose whilst the attachment is fitted.

An object of the invention is to provide an adapter for a powered grinding tool in an efficient and convenient manner.

SUMMARY OF THE INVENTION

According to the invention there is provided an adapter for releasable engagement with a powered grinding tool having a casing, a motor adapted to be driven by power supply means, a rotatable shaft drivable, in use, by the motor, and a rotatable grinding wheel to which drive is transmitted in use, from said shaft, the adapter having engagement means for it to be automatically secured to said casing at a work station of the tool, in use, and to be removed therefrom subsequently, and defining a location which, when the adapter is fitted to said tool at said work station thereof, in use, provides for correct positioning between part of an implement at said location and said grinding wheel for said part to be worked by the wheel, when it is driven, in use.

DESCRIPTION OF THE DRAWINGS

The invention will now be described, by way of example, with reference to the accompanying drawings, in which.

DESCRIPTION OF THE PREFERRED EMBODIMENT

The invention relates to an adapter for use with a powered grinding tool which has a work station at which a selected one of several adapters designed for use with the tool can be releasably fitted, the tool having a casing to which, in the disclosed embodiment, two further adapters can be releasably stored when not fitted at the work station. The casing could be differently arranged to store only one or more than two adapters.

The tool is powered from the mains electricity supply or could have a rechargeable or renewable battery as its power source. The tool has a motor in its casing driving a rotatable shaft on which is carried a grinding wheel at the work station. When fitted at the work station, each adapter provides a location correctly disposed relative to the grinding wheel for part, usually an end, of an implement, to be worked on by the wheel, to be inserted into or onto the location for said working by the wheel. By means of some manual manipulation of the implement in this position, the correct working can be effected.

The tool is advantageous in having its own motor so that it is not an attachment and does not rely on power from a separate tool, such an electric drill. Moreover it is easy to use, allows quick and easy changes of adapters for use with different implements, and conveniently provides storage for adapters not in use, ensuring that when stored they are always at hand and do not become lost.

Figure 1:
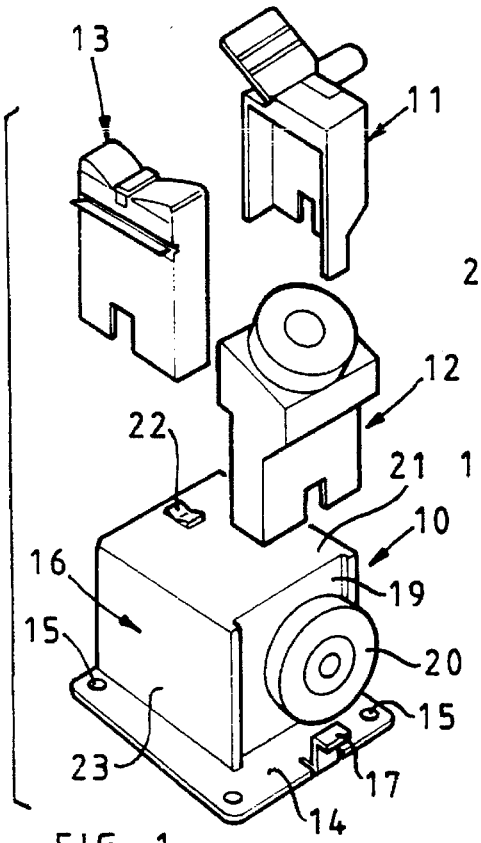
FIG. 1 is an exploded, schematic perspective view showing a powered grinding tool together with an adapter of the invention, as well as two other adapters, for use with and storage at the tool.
Figure 2:
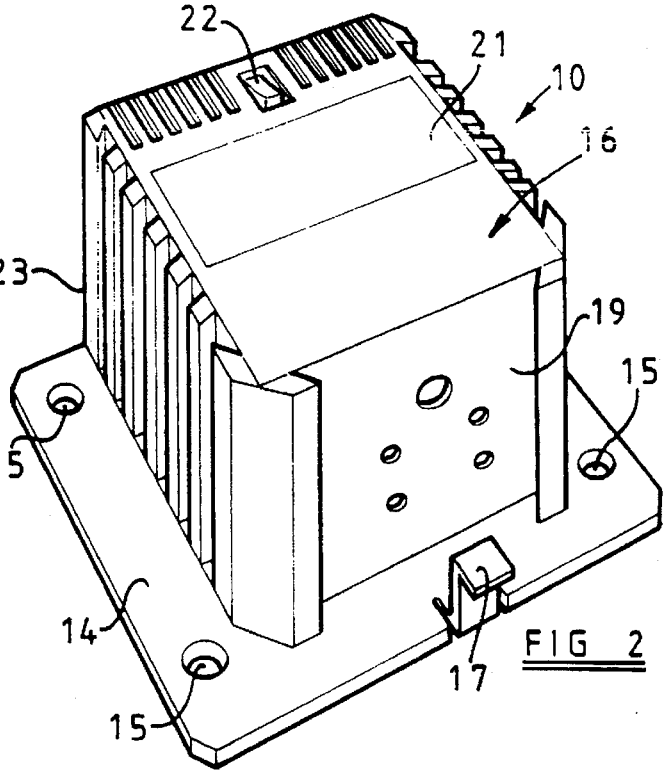
FIG. 2 is a front perspective view of the tool, with a grinding wheel thereof not shown.

FIG. 1 schematically shows the tool 10 with generally three plastics material adapters 11, 12 and 13 respectively, the adapter 11 forming the subject of the invention. The toot has a rectangular plastics material base 14 with screw holes 15 for securing it to a workbench or other surface. Snap-fittingly engaged with the base is a rectangular plastics material casing 16. Adjacent one of its edges the base has on its upper surface an upstanding, hinged, flexible catch 17, which in use is intended to be manually pressed downward and outward when fitting or removing an adapter to the tool. As will be described, the catch 17 has a inwardly directed projection 18 (FIGS. 4 and 5) facing the tool casing for releasable snap-fit engagement with a front face of each adapter to retain it in place, in use.

Figure 8:
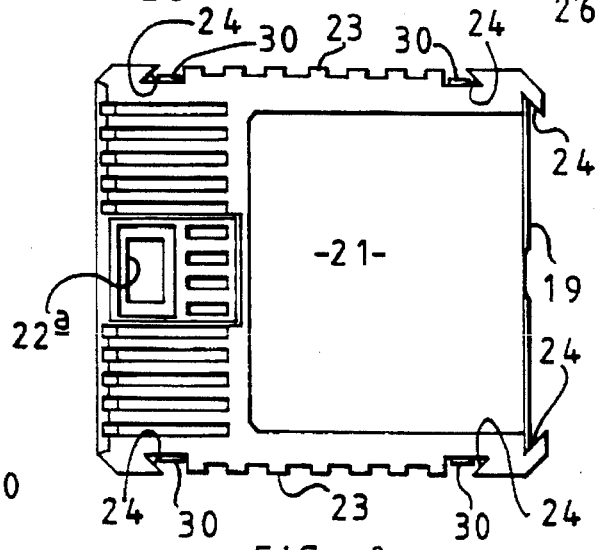
Figure 11:
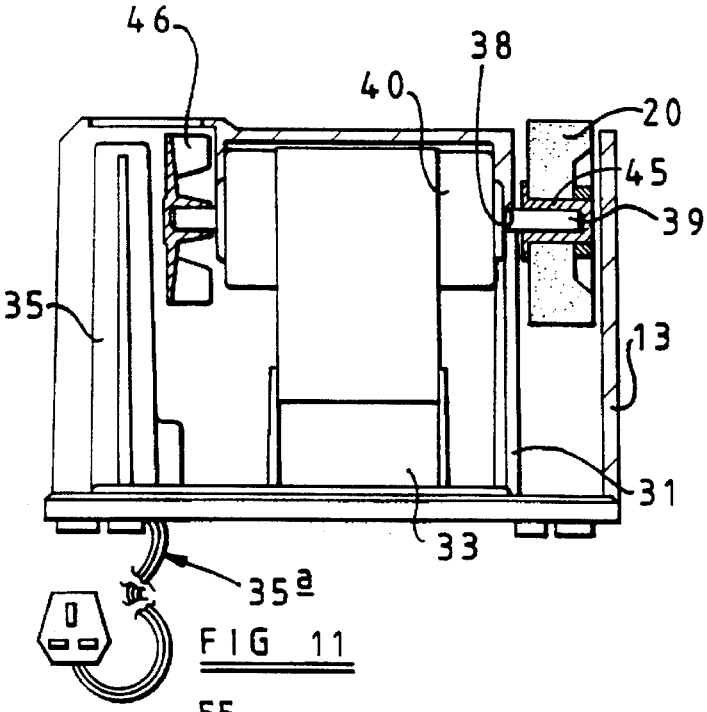
FIG. 11 is a diagrammatic view of part of the inside of the tool showing a motor, fan grinding wheel and power supply means of the tool.
Figure 12:
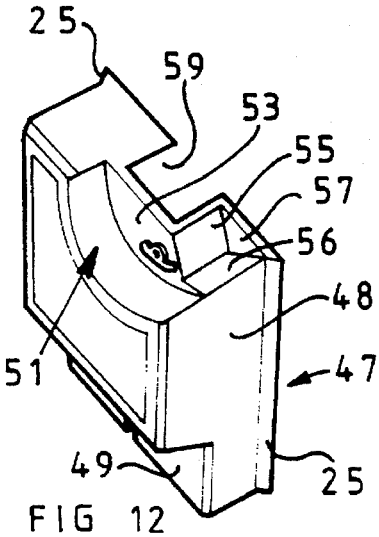
FIGS. 12 and 13 are front and rear perspective views respectively of part of the adapter of FIG. 3.
Figure 13:
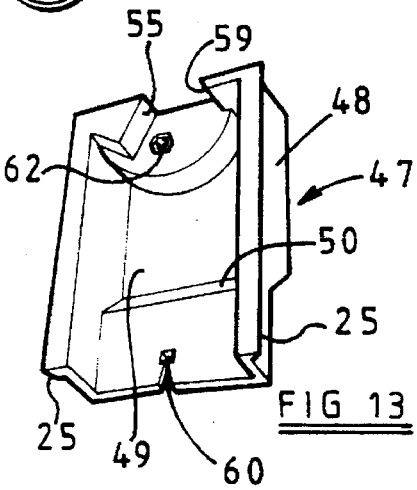
Figure 14:
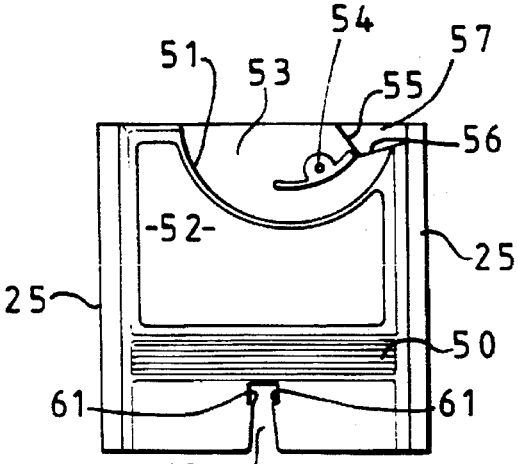
Figure 17:
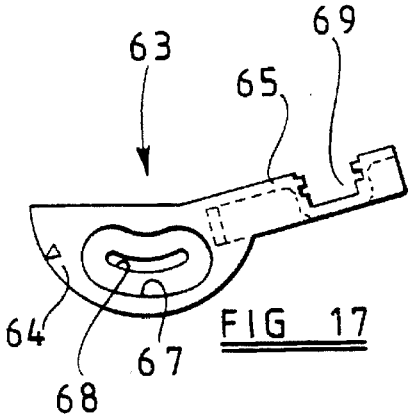
FIGS. 17 and 18 are respectively a front view and a top view of an angle adjustable guide plate of the adapter of FIG. 3.
Figure 18:
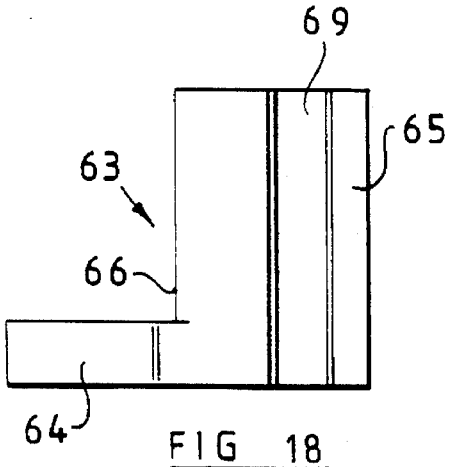
Figure 19:
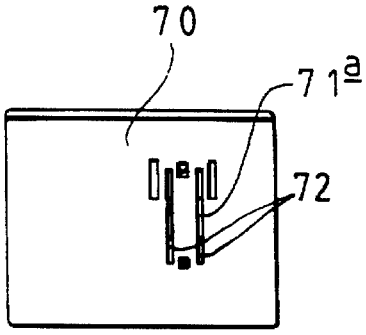
FIGS. 19 and 20 are respectively a top view and an underneath perspective view of a traversing plate of the guide plate of FIGS. 17 and 18.
Figure 20:
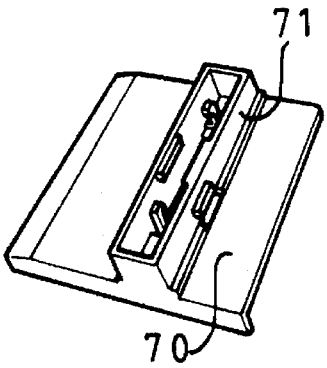

The catch 17 is spaced from a front surface 19 of the casing, at which is arranged a grinding wheel 20, for example of aluminium oxide, so as to define the work station of the tool. The outer surface of the wheel could be flat, or provided with a central annular recess, as shown in FIG. 11. The upper surface 21 of the casing receives an on-off rocker switch 22 for controlling electrical power to the tool, whilst both casing side surfaces 23 are formed as storage areas for respective adapters. As schematically shown in FIG. 1, and more clearly shown for adapter 11 in FIGS. 3 and 12 to 20, each adapter has its longitudinal side edges formed for complementary sliding engagement with respective undercut grooves 24 at opposite ends of both the front surface 19 and also the two side surfaces 23. As shown in FIG. 8, the grooves in this example are half of a dove-tail groove and the two complementary half dove-tail projections 25 are shown for adapter 11 in FIGS. 3 and 12 to 15. Accordingly any one adapter can engagingly be slid down the front of the tool at the work station and fixed by said catch 17, or can engagingly be slid down either side of the tool to be stored thereat.

Shown in FIG. 1 are three adapters, each for use with different forms of implement. Adapter 11 is for use with sharpening chisels and planes, adapter 12 is for sharpening high speed drill bits, whilst adapter 13 is for sharpening knives and scissors. As explained above all have projections 25 at their respective opposite longitudinal edges.

Figure 4:
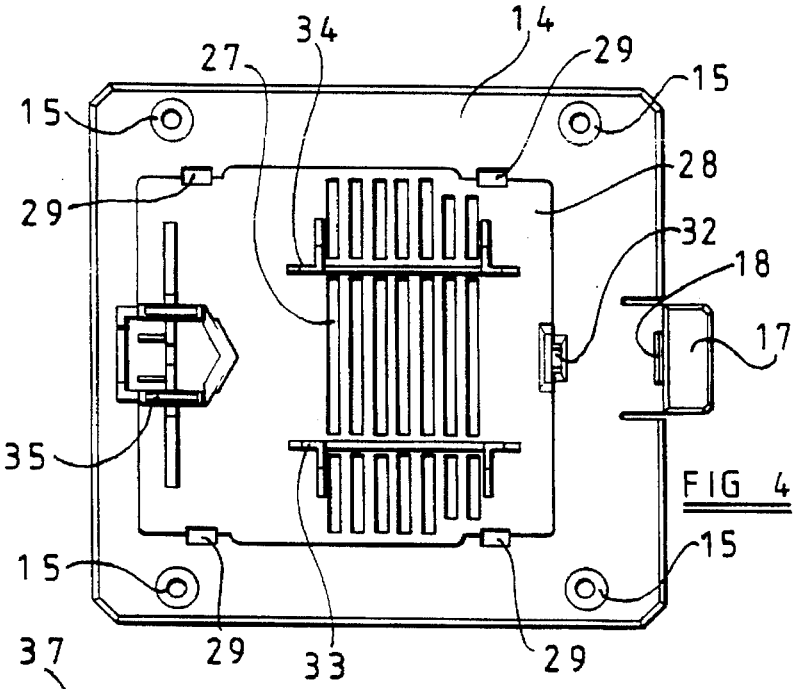
FIG. 4 is a top plan view of a base of a casing of the tool.
Figure 5:
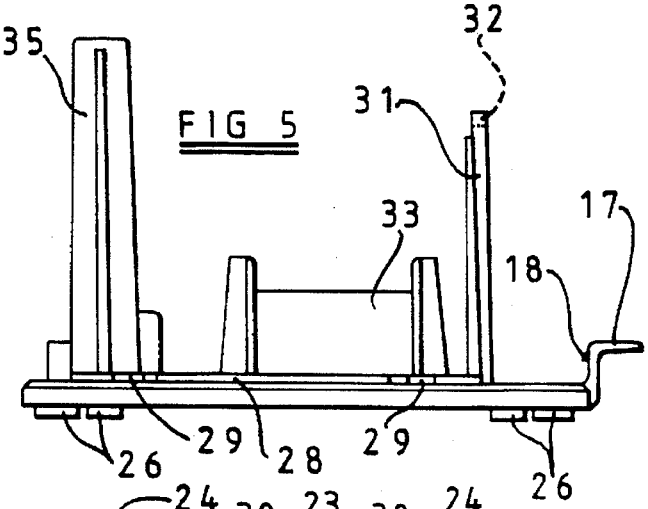
FIG. 5 is a side view of the casing base of FIG. 4.

FIGS. 4 and 5 show the base 14 of the tool. The base has support feet 26 on its underside and is formed with central slots 27 through a central slightly raised rectangular area 28 onto which the casing 16 is fitted on assembly. Adjacent the four corners of the area 28 on two sides thereof are latch openings 29 for snap-fittingly receiving flexible latches 30 complementarily arranged at the bottom of the grooves 24 of the casing, as shown in FIGS. 6, 7, 9 and 10.

Upstanding from a front edge of the area 28 at the centre thereof is an integral tapered finger 31 which has a semi-circular recess 32 in its top surface. Upstanding integrally from the centre of the area 28 at opposite longitudinal ends respectively of an inner set of the slots 27 are support ribs 33, 34. Upstanding integrally from just inside a rear edge of the area 28 at the centre thereof is a guide structure 35.

Figure 6:
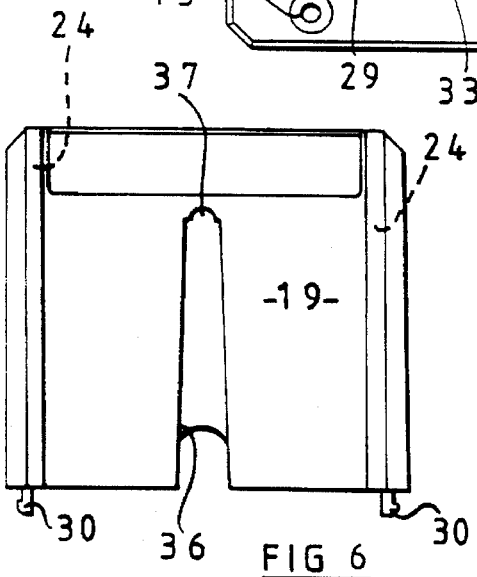
FIG. 6 is a front view of the casing, in a form different from FIG. 2.

The casing is shown in FIGS. 6 to 10. FIG. 6 shows the front surface 19 having the longitudinal half dove-tail, undercut grooves 24 along its sides and the latches 30 thereunder. In its centre it has a tapering opening 36 which is generally complementary to and able to slide over and engage on the finger 31. However the top of the finger 31 remains spaced slightly below the inner top surface 37 of the opening which is semi-circular and with the recess 32 defines a circular opening 38 for a drive shaft 39 of a 220 V A.C. motor 40 of the tool, as shown in FIG. 11.

Figure 7:
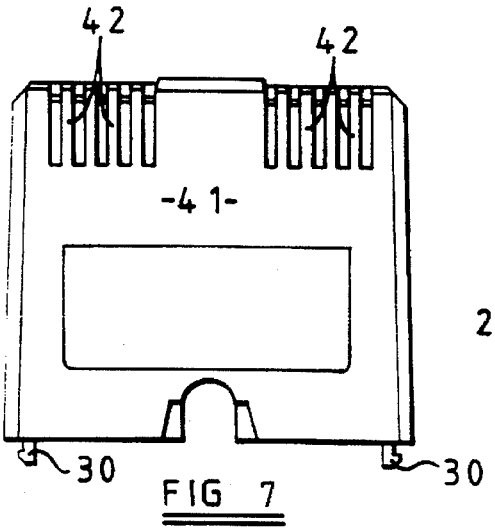
FIGS. 7 to 9 are respectively a rear view, a top view and a side view of the casing.

FIG. 7 shows the rear surface of the casing, denoted by numeral 41, this having open slots 42 at its upper edge, these slots continuing into the upper surface 21 of the casing (FIG. 8) at opposite sides of an opening 22*a* for the switch 22.

Figure 9:
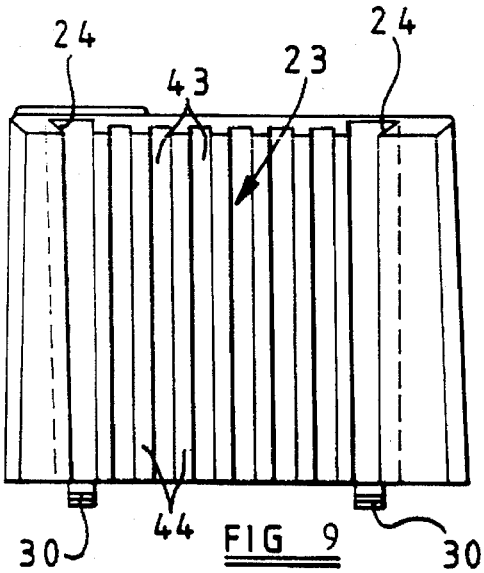
Figure 10:
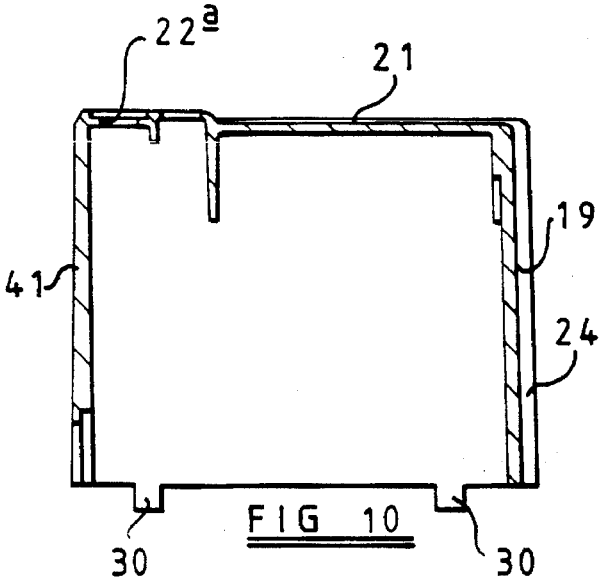
FIG. 10 is a vertical section through the casing.

Each of the side surfaces 23 of the cases has said grooves 24 respectively at its opposite ends as shown in FIGS. 8 and 9, whilst between the grooves are a series of parallel upright ribs 43 separated by parallel grooves 44, the ribs and grooves each having a generally rectangular cross-section.

FIG. 11 shows the motor 40, carried in the casing by means including the support ribs 33, 34, and held both axially and radially. In this embodiment the drive shaft 39 is in permanent, direct drivable engagement with the motor, but alternatively the engagement could be through gearing. The end of the shaft projects through opening 38 to terminate outside of the casing front surface 19 where it carries a plastics material collar 45 with a left hand thread, on which collar is the grinding wheel 20, driven, in use, directly, as shown, or alternatively indirectly, by the motor 40 and shaft 39, and secured in place by an end nut. When an adapter 11, 12 or 13 is fitted at this work station defined at the wheel 20, it substantially shrouds the wheel, which is itself received in a channel part of the adapter, as schematically shown for adapter 13 in FIG. 11. At the rear end of the shaft 39, which protrudes from the motor, a plastics material fan 46 is carried thereon so as to be driven by rotation of the shaft, in use, to effect cooling of the interior of the casing.

As will be appreciated from the foregoing description of the base 14 and casing 16, the casing can be snap-fittingly engaged with the base merely by correctly relatively positioning the latches 30 and latch openings 29 and then forcing the components together. Once engaged together, wires 35*a* supplying electrical power for the motor pass up through the guide structure 35 for co-operation with the switch 22, which is itself arranged to control the motor.

Having now described the body of the tool, the adapter 11 of the invention, already briefly referred to, will now be more fully described.

As shown in FIGS. 3 and 12 to 16, a body 47 of adapter 11 is of generally channel shape with the aforementioned longitudinal projections 25 at the respective side edges of the parallel sides 48 of the channel with its base 49 being stepped at 50 to make the body 47 deeper at its upper part. The lower end of the channel is open, but its upper end is largely closed.

Figure 3:
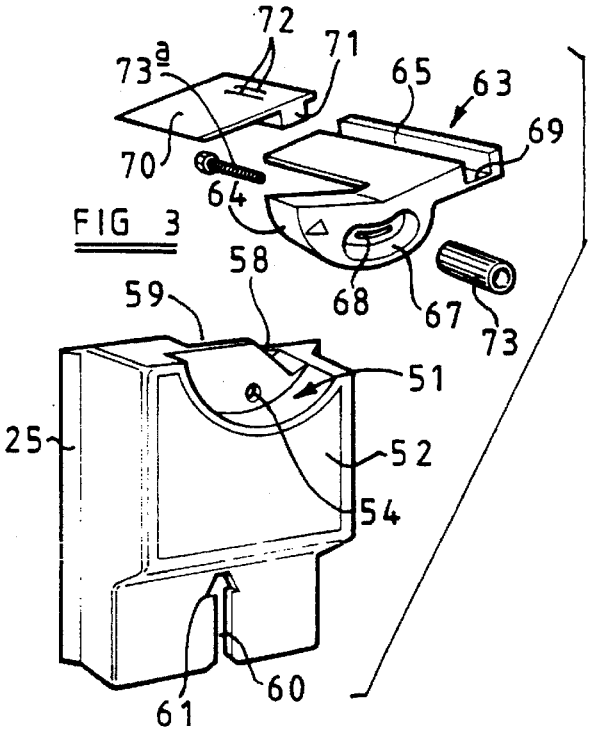
FIG. 3 is an exploded perspective view of the adapter of the invention, intended for use in sharpening chisels and planar blades.
Figure 15:
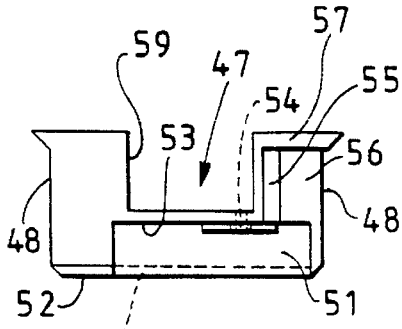
FIGS. 14 to 16 are respectively a front view, a top view and a part sectional side view of the adapter part of FIGS. 12 and 13.
Figure 16:
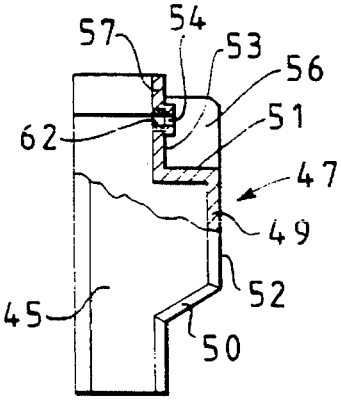

This upper end defines a part-circular recess 51 at a front surface 52 of the body 47, the recess extending rearwardly from the surface 52 for approximately only half of the depth of the upper end of the channel-shaped body 47. The recess has an upstanding rear wall 53, in which is defined a circular through hole 54, the wall terminating just past the hole 54, where slightly above the level of the base of the recess there is an inclined wall 55 normal to wall 53 and extending rearwardly for the remainder of the depth of the upper end of the body. The wall 55 joins an angled surface 56 extending to a side 48 of the body, a rear wall 57 being behind the V-shaped recess formed by wall 55 and surface 56. However as shown in FIG. 3 the walls 55 and 57, together with surface 56 can be omitted, the wall 54 merely terminating at an inclined edge surface 58. Behind the recess 51, and at the side of the wall 55 remote from surface 56, the upper end of the body defines an opening 59 of rectangular shape. In the centre of the front surface 52 of the body at its lowermost edge is an arrow-shaped slot 60 therethrough which defines a pair of shoulders 61. The slot could instead be merely a rectangular aperture. When the adapter is fitted to the work station of the tool, the projection 18 of catch 17 engages in the slot 60 against the shoulders releasably to lock the adapter in place. The rear surface of the wall 53 has a hexagonal recess 62 around the hole 54 for non-rotatably receiving a head of a bolt passing through hole 54, as will be described.

Angularly adjustably mounted on the body 47 at the top thereof is a guide plate 63 having a generally semi-cylindrical body part 64 of complementary external shape to fit in recess 51, and a rearwardly transversely projecting location part 65 at an angle thereto. An angled surface 66 is disposed approximately at the junction of parts 64 and 65, for engaging wall 55 or surface 58. In its front surface the body part has a recess 67, in the base of which is an arcuate slot 68. The part 65 defines a rearwardly extending guideway 69 therein for the transverse sliding, relative to the adapter front face, in use, of a traversing plate 70. The plate 70 has a housing 71 on its underside for holding a magnet assembly consisting of a permanent magnet 71*a* (FIG. 19) held between a pair of steel side plates (not shown). The plate is slotted at 72 to allow for magnetic attraction at the upper surface of plate 70. The housing 71 is also externally shaped for engagement in the guideway for sliding thereal-long.

In use the body part 64 of the guide plate is disposed in the recess 51 with a threaded shank of a hexagon headed bolt 73*a* passing from the rear of body 47 through the hole 54 and slot 68, with the head engaging in complementary shaped recess 62. The end of the shank is threadedly engaged with an internally threaded clamping member 73 extending into recess 67 to hold body part 64 against body 47. The member 73 can thus be screwed up to secure the guide plate 63 in a fixed orientation relative to the body 47, thereby particularly to orientate the plate 70 at a chosen angle to the opening 59 through which, in use, with the adapter fitted on the casing at said work station, the wheel 20 projects somewhat. In one extreme position of the guide plate 63 the surface 66 thereof engages against wall 55 (or edge surface 58). By unscrewing the member 73 the plate 63 can be angularly moved from this extreme position to increase the angle of tilt of the plate 70. Whatever the angle, however, the engagement of the adapter at the work station ensures that it locates relative to the wheel 20 for correct working of implements magnetically held on the plate 70. An angle scale can be provided for accurate adjustment.

In use the adapter 11 is intended for use in sharpening chisels and planar blades. A chisel end, for example, is placed on the plate 70 and retained thereon by the magnets. The end of the chisel is in contact with the wheel 20 and adjustment can be made by manually sliding it over the wheel and also by altering the angle of the plate 70, as described, by means of member 73. After correct adjustment, sharpening is effected by traversing the tool and plate 70 across the wheel along guideway 69.

It will be appreciated that further adapters to those disclosed can be sold as part of the tool or as separate add-on components. The three adapters 11, 12 and 13 are considered to provide common implement working requirements and further adapters could be for more specialised use. Further adapters would of course have projections 25 and a slot 60 (or equivalent) to engage and lock with the casing and base respectively. Normally the further adapters would be of plastics material.

In an alternative form of the tool 10, the motor could drive a further shaft, like the shaft 39, but which projects from the rear of the casing to define a further work station at which adapters might or might not be engageable. Gearing could be provided in the casing so that the two wheels could operate or be operated at different rotational speeds. The permanent second wheel could be of white stone for honing.

The adapters which provide for utilisation of a grinding wheel accurately position a location for part of an implement to be worked on, when it is engaged at the work station. Moreover each location provides some support for the implement, although it would normally be necessary for the implement to be held during the working by the wheel. Any material ground from the implement during working will fall between the casing front surface and the adapter, to the base, from where it can easily be cleared once the adapter is removed.

Although the part dove-tail slot and projection arrangement disclosed is particularly satisfactory for slidingly engaging an adapter at a work station or a storage position of the casing, any suitable alternative means could be used, even screws or the like.

The grinding wheel of the tool can have a flat or recessed front surface. A recess is more desirable as it accommodates the end of the motor shaft and fixing nut below the front grinding surface. The use of different wheel compositions (grit size and type) is selected to match the tool's typical material. For example tungsten carbide requires what is commonly known as green grit or diamond, whilst with honing, which is usually a finer grinding process, and sometimes used wet, the grit is usually white alumina and of finer grade.

I claim:

1. An adapter for releasable engagement with a powered grinding tool including support means, a motor mounted within said support means and adapted to be driven by power supply means, a rotatable shaft drivable by the motor, and a rotatable grinding wheel to which drive is transmitted from said shaft, the adapter having engagement means for it to be secured in releasable snap-fit engagement to said support means at a work station of the tool and to be removed therefrom subsequently, the adapter defining a location which, when the adapter is secured to said tool at said work station provides for correct positioning between part of an implement at said location and said grinding wheel for said part to be worked by the wheel when it is driven, said adapter comprising a lower portion of generally channel shape having spaced sides and there being said engagement means at said sides respectively for securing said adapter to said casing of the tool to retain the adapter at said work station against lateral movement, and said engagement means at its sides are projections for engagement with complementary undercut slots at the casing.

2. An adapter as claimed in claim 1, comprising a slidable implement receiving element for receiving said implement.

3. An adapter as claimed in claim 2, wherein said implement receiving element is slidable in a guideway of a guide member which itself is angularly adjustable relative to a body of the adapter.

4. An adapter as claimed in claim 3, wherein an upper end of the body has an opening therein through which, in use, said grinding wheel projects when the adapter is secured to said casing at said work station.

5. An adapter as claimed in claim 4, wherein a side of said implement receiving element terminates at said opening so that said part of said implement carried on said element can be worked by the grinding wheel when the adapter is secured to said tool at said work station, sliding movement of the implement receiving element being transverse of the opening to move the implement part across the outer peripheral surface of the wheel.

6. An adapter as claimed in claim 4 or claim 5, wherein said guide member is received in a recess in a front face of the body of the adapter, the recess having an arcuate surface on which a complementarily shaped exterior surface of the guide member engages, angular movement of the guide member in the recess, when the adapter is fitted to said tool at said work station, changing the angle of engagement of said implement part with said outer peripheral surface of the wheel.

7. An adapter as claimed in claim 6, wherein the guide member is releasably held in a selected angular position in the recess by a clamping member which clamps the guide member against a rear wall of the recess.

8. An adapter as claimed in claim 3, wherein an angular adjustment scale is provided for guide member adjustment.

9. An adapter as claimed in claim 2, wherein the implement receiving element includes magnetic means for holding an attracted implement to the element.

10. An adapter for releasable engagement with a powered grinding tool including support means, a motor mounted within said support means and adapted to be driven by power supply means, a rotatable shaft drivable by the motor, and a rotatable grinding wheel to which drive is transmitted from said shaft, the adapter having engagement means for it to be secured in releasable snap-fit engagement to said support means at a work station of the tool and to be removed therefrom subsequently, the adapter defining a location which, when the adapter is secured to said tool at said work station provides for correct positioning between part of an implement at said location and said grinding wheel for said part to be worked by the wheel when it is driven, said adapter comprising a lower portion of generally channel shape having spaced sides and there being said engagement means at said sides respectively for securing said adapter to said casing of the tool to retain the adapter at said work station against lateral movement, and said engagement means at its sides being complementary undercut slots for engagement with projections at the casing.

* * * * *